United States Patent [19]

Ackermann et al.

[11] 4,420,269

[45] Dec. 13, 1983

[54] DEVICE FOR LIFTING THE PRINTING HEAD OFF THE PLATEN

[75] Inventors: Rolf Ackermann, Nuremberg; Friedrich Jung, Erlangen; Egon Mauer, Furth; Hermann Rupertinger, Oberasbach, all of Fed. Rep. of Germany

[73] Assignee: Triumph-Adler A.G. fur Buro- und Informationstechnik, Nuremberg, Fed. Rep. of Germany

[21] Appl. No.: 348,090

[22] Filed: Feb. 11, 1982

[30] Foreign Application Priority Data

Mar. 27, 1981 [DE] Fed. Rep. of Germany ..... 3112079

[51] Int. Cl.[3] ..... B41J 11/20

[52] U.S. Cl. ..... 400/356; 400/320; 400/59; 400/56

[58] Field of Search ..... 400/320, 355, 356, 124, 400/55, 56, 59

[56] References Cited

U.S. PATENT DOCUMENTS

| | | | |
|---|---|---|---|
| 3,628,645 | 12/1971 | McFeaters | 400/320 |
| 3,817,365 | 6/1974 | Zimmermann | 400/124 |
| 3,910,395 | 10/1975 | Colglazier et al. | 400/320 |
| 4,098,389 | 7/1978 | Kwan | 400/124 |
| 4,265,551 | 5/1981 | Adamek et al. | 400/55 X |

OTHER PUBLICATIONS

Brown, Henry T.; *507 Mechanical Movements;* Brown & Allen Pub.; New York; 1876; pp. 30–31.

*Primary Examiner*—Edgar S. Burr
*Assistant Examiner*—David A. Wiecking
*Attorney, Agent, or Firm*—Joseph R. Spalla

[57] ABSTRACT

A printer having a carriage guided for movement along a platen and supporting a wire matrix printing element includes means for changing the distance between the printing element and the platen an amount to facilitate paper feeding and an additional amount for paper insertion.

The means of changing the distance between printing element and platen includes an electric motor driven in accordance with a stored program which determines motor acceleration characteristics.

1 Claim, 5 Drawing Figures

Fig_3
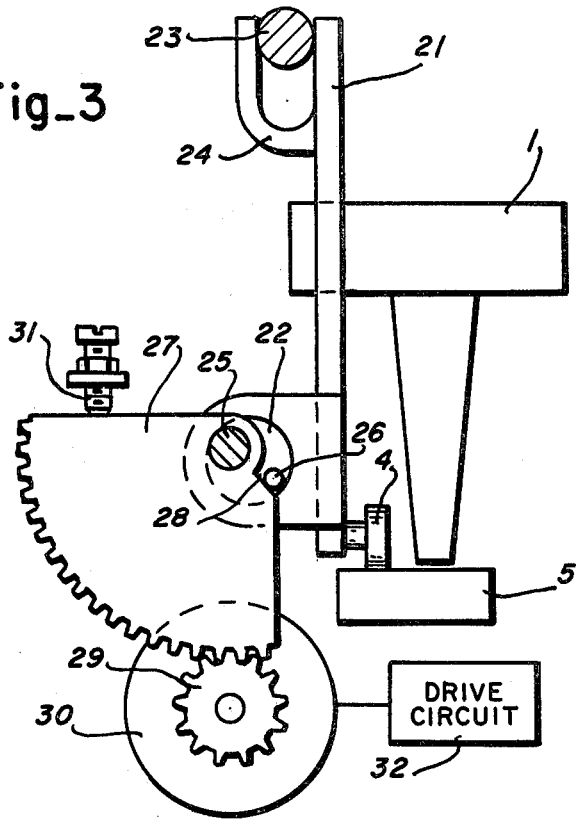
Fig_4
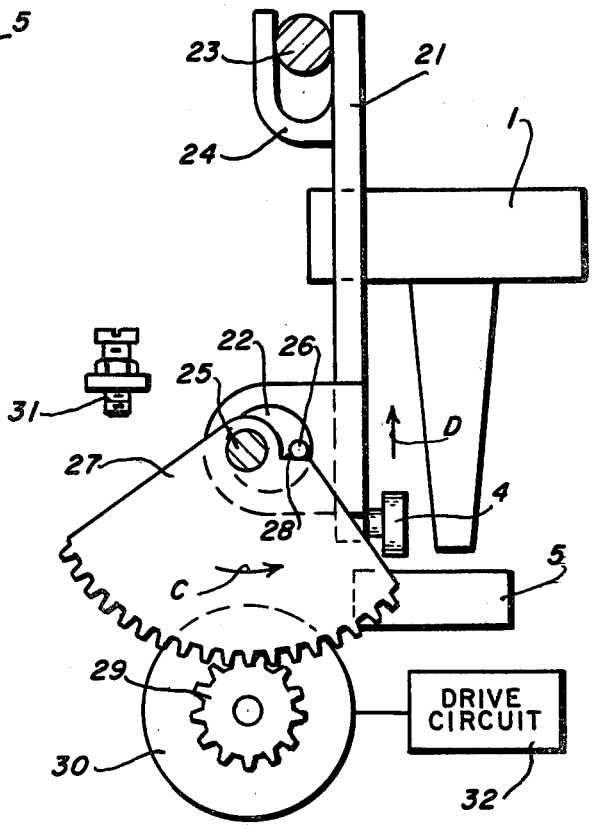
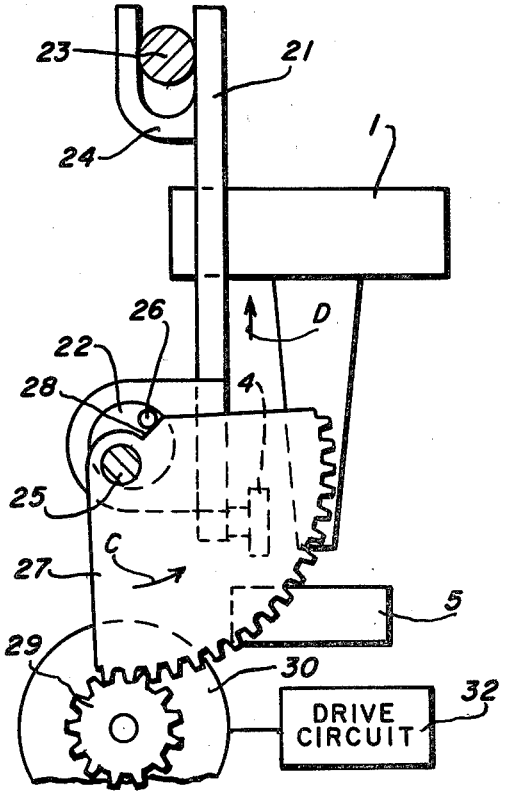
Fig_5

DEVICE FOR LIFTING THE PRINTING HEAD OFF THE PLATEN

The invention relates to a device in a matrix printer with a printing element supported on a movable carriage; more particularly it relates to means for changing the distance between the printing element and a platen.

In matrix printers, to achieve high printing speeds, it is necessary that the printing element be held at a constant spacing close to the paper to be printed on. To maintain a constant spacing paper thickness sensors are employed in the prior art. These take the form of a roller rotatably mounted to the printing element or to the carriage supporting the printing element. The periphery of the roller engages the paper proximate the character printing point as the carriage moves in line direction and rolls along the paper so that the spacing between printing element and paper to be printed on is always kept constant, irrespective of the paper thickness.

However, in that the paper to be printed on is being clamped between roller and platen by the paper thickness sensing roller it was found necessary to facilitate line feeding of the paper at the end of a line to lift the paper thickness sensing roller away from platen far enough to be able to move the paper unhindered.

U.S. Pat. No. 3,817,365 shows an arrangement of the kind described wherein the paper to be printed on is released during carriage return to facilitate paper feeding. As described therein an electromagnet acts to release a latch holding the printing element close to the platen in such a manner that the printing element moves away from the platen.

The prior art arrangements have a number of disadvantages among which are noise and vibration.

A feature of the invention resides in the fact that instead of an electromagnet an electric motor is used whose accelleration can be controlled not only to achieve better noise behavior and with less current consumption, but which can be controlled to space the printing element different distances from the platen to facilitate paper feeding and further to facilitate paper insertion.

Another feature resides in the fact that gearing to translate rotary motion of the motor into print element lift motion is of simple design comprising few parts, and in the fact that a stepping motor is used as will permit control of the printing element into several positions different distances away from the platen. This is particularly advantageous in that the printing head need not be raised to facilitate line feeding as far as when inserting a new sheet of paper, for instance. The shorter movement to facilitate line feeding makes possible a quicker conclusion of the lifting process and, hence, a greater printing speed.

An object of the invention is to provide mechanism for controlling the distance of a matrix print head from the platen which overcomes the shortcoming of the prior art.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 3 is an elevational view of another embodiment with the printing element in printing position;

FIG. 4 is an elevational view showing the embodiment of FIG. 3 in a first raised position to facilitate paper feeding, and FIG. 5 is an elevational view showing the embodiment of FIG. 3 in a second raised position to facilitate paper insertion.

Figure 1:
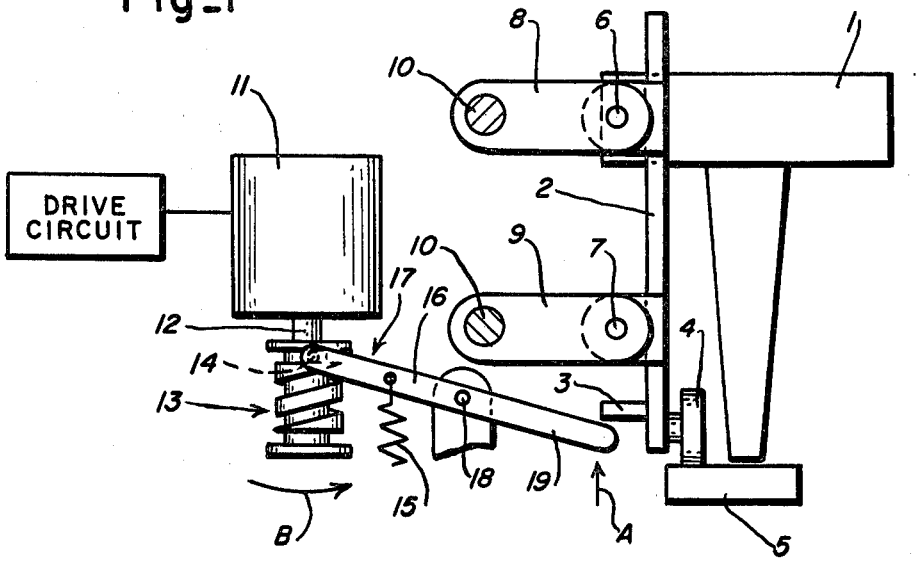
FIG. 1 is an elevational view of one embodiment of the invention with the printing element in printing position.
Figure 2:
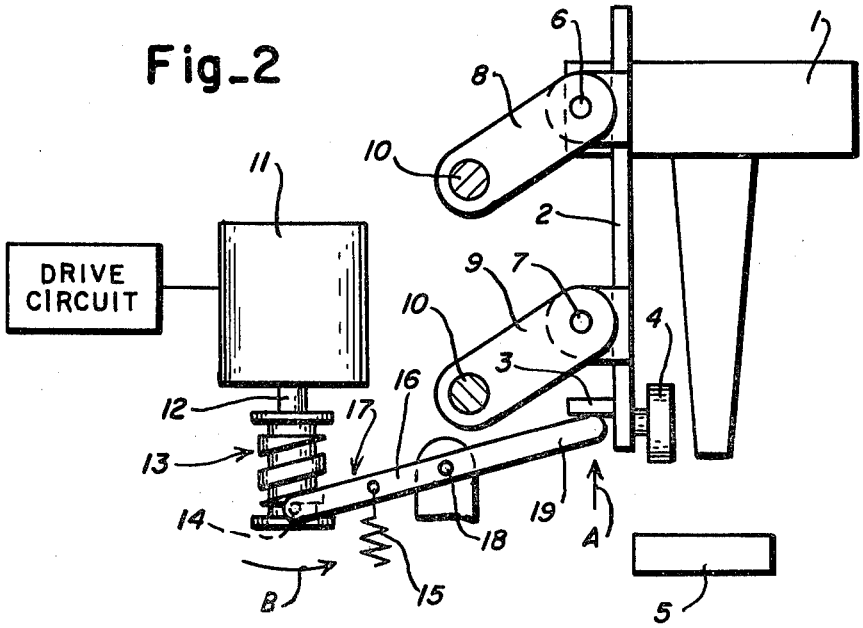
FIG. 2 is an elevational view showing the embodiment of FIG. 1 in raised position.

Referring now to the drawing there is shown FIGS. 1 and 2 show a printing head 1 fastened to a carriage 2 which has at its lower end a lug 3 and, opposite the latter, a paper thickness sensing roller 4 which, in turn, rests on a platen 5. At 6 and 7, one end each of intermediate parts 8, 9 are rotatably connected to the carriage 2 while their other ends are rotatably mounted in guiding means 10.

An electric motor 11, mounted in the housing of the printer (not shown) supports on its shaft 12 a threaded spindle 13, both thread ends of which wind up in a zero lead thread turn. The thread of the threaded spindle 13 is engaged by a driver 14 located at the end of a spring 15 loaded lever arm 16 of a dual armed lever 17 pivotally mounted in the printer housing (not shown) at 18. The second lever arm 19 of the dual armed lever 17 is arranged so that it will engage the lug 3 of the carriage 2 upon being pivoted about 18 in direction A.

To lift the printing head 1 off the platen 5 the electric motor is energized as by a drive circuit so that the shaft 12 and with it the threaded spindle 13 turn in direction B. Due to the force of spring 15, the driver 14 located at the first lever arm 16 of the dual armed lever 17 is pulled into the thread of the threaded spindle 13 and due to the latter's rotation, transported to the opposite end of the thread so that the lever 17 is pivoted about the pivot point 18. Due to the pivoting motion of lever 17, its second lever arm 19 engages the lug 3 of the carriage 2, lifting it off the platen in direction A, to the position shown in FIG. 2 during which process the intermediate parts 8, 9 rotate about 6, 7 and 10.

To return the printing head from the FIG. 2 to the FIG. 1 operating position, the electric motor 11 is energized so as to turn opposite to the direction B. Due to the weight of the printing head 1 and the carriage 2, which rests on the second lever arm 19 of the dual-armed lever 17, the driver 14 fastened to the first lever arm 16 is pushed into the thread of the threaded spindle 13 and transported to the opposite end of the thread due to the spindle rotation. This causes the second lever 19 of the lever 17 to pivot back into its original position, thereby releasing the lug 3 of the carriage 2 so that roller 4 again rests on platen at which time the printing head 1 resumes its FIG. 1 operating position.

With reference to FIGS. 3, 4 and 5 there is shown a second embodiment of the arrangement according to the invention wherein a printing head 1 is fastened to a printing carriage 21 which is rotatably mounted to a first guide rod 22 and an arm 24 of which grips around a second guide rod 23. The guide rod 22 is rotatably mounted in a printer housing (not shown) by means of two bearing pins 25 eccentrically disposed at its end surfaces. In addition, one end surface of guide rod 22 has an axially extending eccentric pin 26. Mounted to one of the bearing pins 25 is a gear segment 27 which has a drive surface 28, and whose teeth mesh with a pinion 29 connected to an electric motor 30 preferably a stepping motor. As in the embodiment of FIG. 1 the printing carriage 21 rotatably supports a paper thickness sensing roller 4 resting against a platen 5.

FIG. 4 shows the device moved from FIG. 3 to a first position raised from the platen 5. Raising is accomplished by energizing the electric motor 30 which causes the pinion 29 to turn so that the gear segment 27 is pivoted in direction C. This causes the drive surface 28 of the gear segment 27, in contact with the pin 26, to turn the guide rod 22, mounted by its bearing pins 25 in the printer housing, so that the printing carriage 21 performs a lifting motion in direction D to that shown in FIG. 4. To keep the printing head or the printing carriage 21 in the FIG. 4 raised position, the friction of the arrangement or the retaining moment of the stepping motor 30 is sufficient. Paper transport is made possible in this first raised position.

In order to insert a new sheet of paper into the printing device, the printing carriage 21 and the printing head 1 are desirably raised into a second position further removed from the platen 5, as shown in FIG. 5. The lifting process for this purpose is identical to the lifting process into a first position as described above, except that the gear segment 27 is pivoted by a greater angular distance.

The printing carriage 21 or printing head 1 are lowered into their operating position by energizing the electric motor 30 so that its direction of rotation is reversed, whereby the pinion 29 pivots the gear segment 27 opposite to the direction C so that printing carriage 21 and printing head 1 return to the operating position and the paper thickness sensing roller 4 rests on the platen 5 again. In this position, the gear segment 27 is in contact with a stop 31.

Due to the use of a stepping motor 30 it is possible within the limits of the mechanical arrangement to raise the printing carriage or the printing head into any desired position.

By means of a suitable drive circuit 32 for the electric motor or stepping motor the device can be operated in such a manner, by storing an energizing program in the drive circuit 32, that all acceleration processes occurring are of sine wave form when plotted over time. As is generally known, the motion cycles of mechanical arrangements controlled in this manner have the property of causing a minimum of noise and of keeping the wear of moving parts as low as possible.

As is evident from the specification above, the device according to the invention and the method for the operation of the device provide the possibility to raise a printing head into one or more positions removed from the platen at minimum noise development and minimum wear while keeping the design as simple as possible.

While the drawing illustrate a geometry wherein the carriage supported roller rests on a platen 5 defining a horizontal printing plane, it should be understood that the carriage and roller could be urged as by a spring into contact with a platen defining a vertical printing plane.

The invention claimed is:

1. In a printer having a platen, a pair of frame supported guide rods extending parallel to said platen, and a carriage supporting a printing element, means mounting said carriage on said guide rods for movement along said platen and for movement transverse to said platen, one of said guide rods being eccentrically rotatably supported whereby rotation thereof will move said carriage away from engagement with said platen, means on said carriage normally engaging said platen to establish a normal distance between said printing element and said platen, a bidirectional stepper motor, drive circuitry for energizing said motor to effect movement of said carriage away from and back into engagement with said platen to facilitate paper movement between said printing element and said platen during the time said carriage is away from engagement with said platen, means driven by said motor for moving said carriage to a first position away from engagement with said platen and to a second position further away from engagement with said platen when said motor is energized in response to a line feed signal and to a paper insertion signal, respectively, said means driven by said motor for moving said carriage comprising, a gear segment rotatably mounted on the rotational support of said eccentrically supported guide rod, a pinion gear on said motor for driving said gear segment, a drive surface on said gear segment, and an eccentric pin extending axially from the end of said eccentrically supported guide rod in the path of said drive surface to be driven thereby and to thereby rotate said eccentrically supported guide rod.

* * * * *